US010745246B2

(12) United States Patent
Fonteneau et al.

(10) Patent No.: US 10,745,246 B2
(45) Date of Patent: Aug. 18, 2020

(54) ELEVATOR SYSTEM

(71) Applicant: Otis Elevator Company, Farmington, CT (US)

(72) Inventors: Nicolas Fonteneau, Vitry Aux Loges (FR); Frederic Beauchaud, Coullons (FR); Emmanuel Convard, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 261 days.

(21) Appl. No.: 15/567,216

(22) PCT Filed: Apr. 17, 2015

(86) PCT No.: PCT/IB2015/000642
§ 371 (c)(1),
(2) Date: Oct. 17, 2017

(87) PCT Pub. No.: WO2016/166563
PCT Pub. Date: Oct. 20, 2016

(65) Prior Publication Data

US 2018/0354754 A1 Dec. 13, 2018

(51) Int. Cl.
*B66B 7/02* (2006.01)
*B66B 11/00* (2006.01)

(52) U.S. Cl.
CPC ..... *B66B 7/022* (2013.01); *B66B 7/021* (2013.01); *B66B 11/0045* (2013.01)

(58) Field of Classification Search
CPC ..... B66B 7/021; B66B 7/022; B66B 7/027; B66B 11/0035; B66B 11/0045
See application file for complete search history.

(56) References Cited

U.S. PATENT DOCUMENTS 6,488,124 B1 12/2002 Yasuda et al.
6,598,707 B2 7/2003 Nakagaki et al.
(Continued)

FOREIGN PATENT DOCUMENTS

CN 203033615 U 7/2013
EP 0688735 A2 12/1995
(Continued)

OTHER PUBLICATIONS

PCT ISR Written Opinion; International Application No. PCT/IB2015/000642; International Filing Date: Apr. 17, 2015, dated Dec. 22, 2015, pp. 1-6.
(Continued)

*Primary Examiner* — Minh Truong
(74) *Attorney, Agent, or Firm* — Cantor Colburn LLP

(57) ABSTRACT

An elevator system is provided including a hoistway having a plurality of landings. An elevator car is configured to move within the hoistway between the plurality of landings. A plurality of guide rails guide movement of the elevator car and a counterweight within the hoistway. Each guide rail includes a base and a blade. A machine assembly is mounted within the hoistway and includes a traction sheave rotatable about an axis. The traction sheave is configured to drive movement of the elevator car between the plurality of landings. At least one of the plurality of guide rails is arranged in an overlapping configuration with the machine assembly such that a plane defined by the base of the guide rail is parallel to the axis and intersects a portion of the traction sheave.

10 Claims, 6 Drawing Sheets

(56) References Cited

U.S. PATENT DOCUMENTS

| | | | | |
|---|---|---|---|---|
| 6,691,833 | B1 | 2/2004 | Elsener et al. | |
| 6,830,131 | B2 | 12/2004 | Mustalahti et al. | |
| 6,851,519 | B2 * | 2/2005 | Ach | B66B 11/008 187/254 |
| 7,293,631 | B2 | 11/2007 | Ishii et al. | |
| 7,413,055 | B2 | 8/2008 | Kawasaki et al. | |
| 7,523,810 | B2 | 4/2009 | Cloux et al. | |
| 7,549,514 | B2 * | 6/2009 | Heggli | B66B 7/021 187/266 |
| 8,109,367 | B2 | 2/2012 | Ach | |
| 8,522,927 | B2 * | 9/2013 | Fischer | B66B 7/021 187/254 |
| 8,820,483 | B2 | 9/2014 | Ericson et al. | |
| 10,005,642 | B2 | 6/2018 | Valjus et al. | |
| 2004/0108170 | A1 * | 6/2004 | Kocher | B66B 7/021 187/254 |
| 2006/0175149 | A1 * | 8/2006 | Det | B66B 7/027 187/406 |
| 2012/0145489 | A1 | 6/2012 | Tian et al. | |
| 2015/0291395 | A1 * | 10/2015 | Fargo | B66B 7/023 187/254 |

FOREIGN PATENT DOCUMENTS

| | | | |
|---|---|---|---|
| EP | 1216949 | A2 | 6/2002 |
| EP | 1333000 | A1 | 8/2003 |
| EP | 1400477 | A2 | 3/2004 |
| EP | 1673302 | A1 | 6/2006 |
| EP | 1698581 | A1 | 9/2006 |
| EP | 2067734 | A1 | 6/2009 |
| EP | 2134637 | A1 | 12/2009 |
| EP | 2639194 | A1 | 9/2013 |
| WO | 03043926 | A1 | 5/2003 |
| WO | 2008095324 | A1 | 8/2008 |
| WO | 2014070208 | A1 | 5/2014 |

OTHER PUBLICATIONS

PCT; Notification of Transmittal of the International Search Report and the Written Opinion of the International Searching Authority, or the Declaration; International Application No. PCT/IB2015/000642; International Filing Date: Apr. 17, 2015, dated Dec. 22, 2015, pp. 1-6.

Chinese Office Action; Application No. 201580078943.9; dated Jul. 1, 2019; 5 pages.

Chinese Office Action; Application No. 201580078943.9; dated Nov. 2, 218; 4 pages.

Chinese Search Report; Application No. 201580078943.9; dated Oct. 23, 2018; 2 pages.

European Office Action; Application No. 15756452.7-1017; dated Jul. 17, 2019; 6 pages.

* cited by examiner

ELEVATOR SYSTEM

CROSS REFERENCE TO RELATED APPLICATIONS

This application is a National Stage application of PCT/IB2015/000642, filed Apr. 17, 2015, which is incorporated by reference in its entirety herein.

BACKGROUND

Exemplary embodiments of the invention relate to an elevator system, and more particularly, to a machine assembly for moving an elevator car of an elevator system.

Elevators carry passengers, cargo, or both between different levels in a building for example. There are different mechanisms for moving an elevator car within a hoistway. Traction-based elevator systems utilize a roping arrangement for suspending the elevator car and moving the car as desired within the hoistway. Most traction based systems include a counterweight. Traditionally, traction based elevator systems include a machine room in which the elevator machine, drive, and control components are located. For example, a separate structural room is positioned at the top of the hoistway, such as on a roof of a building. The machine room provides access to the motor, brake, drive, and controller components for service and maintenance operations. A modern trend in elevator systems has been to eliminate the machine room and provide a machine roomless elevator system. Eliminating the machine room provides the advantage of reducing construction cost otherwise associated with providing a separate machine room.

In current machine roomless elevator systems, the machine assembly is generally located above the roof of the elevator car when the elevator is at the top landing of the hoistway, to maximize the space in the hoistway available for the counterweight. Consequently, to access the machine assembly, such as for inspection or to perform maintenance, a mechanic may either stand on top of the car or use a ladder extending through a panel of the roof of the elevator car. Elevator codes, particularly in Europe, are expected to require an increase in clearance at the top of the hoistway. There is therefore a need to reposition the machine assembly within the hoistway to avoid increasing the hoistway dimensions and to provide a mechanic access to the elevator machine from inside the car when the car is parked at an adjacent landing.

SUMMARY OF THE INVENTION

According to an embodiment, an elevator system is provided including a hoistway having a plurality of landings. An elevator car is configured to move within the hoistway between the plurality of landings. A plurality of guide rails guide movement of the elevator car and a counterweight within the hoistway. Each guide rail includes a base and a blade. A machine assembly is mounted within the hoistway and includes a traction sheave rotatable about an axis. The traction sheave is configured to drive movement of the elevator car between the plurality of landings. At least one of the plurality of guide rails is arranged in an overlapping configuration with the machine assembly such that a plane defined by the base of the guide rail is parallel to the axis and intersects a portion of the traction sheave.

In addition to one or more of the features described above, or as an alternative, in further embodiments the at least one guide rail is positioned within an opening formed in the traction sheave.

In addition to one or more of the features described above, or as an alternative, in further embodiments the opening is sized to avoid interferences with a guide assembly movably coupled to the blade of the at least one guide rail.

In addition to one or more of the features described above, or as an alternative, in further embodiments at least one notch is formed in the base of the at least one guide rail such that a clearance exists between an outer periphery of the traction sheave and the base of the at least one guide rail.

In addition to one or more of the features described above, or as an alternative, in further embodiments multiple guide rails are arranged in an overlapping configuration with the machine assembly. Each guide rails is arranged within a footprint of the machine assembly.

In addition to one or more of the features described above, or as an alternative, in further embodiments multiple guide rails are arranged in an overlapping configuration with the machine assembly. At least one of the guide rails is arranged outside of a footprint of the machine assembly.

In addition to one or more of the features described above, or as an alternative, in further embodiments the at least one guide rail extends vertically above the machine assembly.

In addition to one or more of the features described above, or as an alternative, in further embodiments the machine assembly is arranged adjacent a top landing of the plurality of landings.

In addition to one or more of the features described above, or as an alternative, in further embodiments when the elevator car is parked at an adjacent landing, the machine assembly is accessible from an interior of the elevator car.

In addition to one or more of the features described above, or as an alternative, in further embodiments the at least one guide rail arranged in an overlapping configuration with the machine assembly is formed from solid steel.

In addition to one or more of the features described above, or as an alternative, in further embodiments the at least one guide rail arranged in an overlapping configuration with the machine assembly is formed from bent sheet metal.

BRIEF DESCRIPTION OF THE DRAWINGS

The subject matter, which is regarded as the invention, is particularly pointed out and distinctly claimed at the conclusion of the specification. The foregoing and other features and advantages of the invention are apparent from the following detailed description, taken in conjunction with the accompanying drawings, in which:

Figure 1:
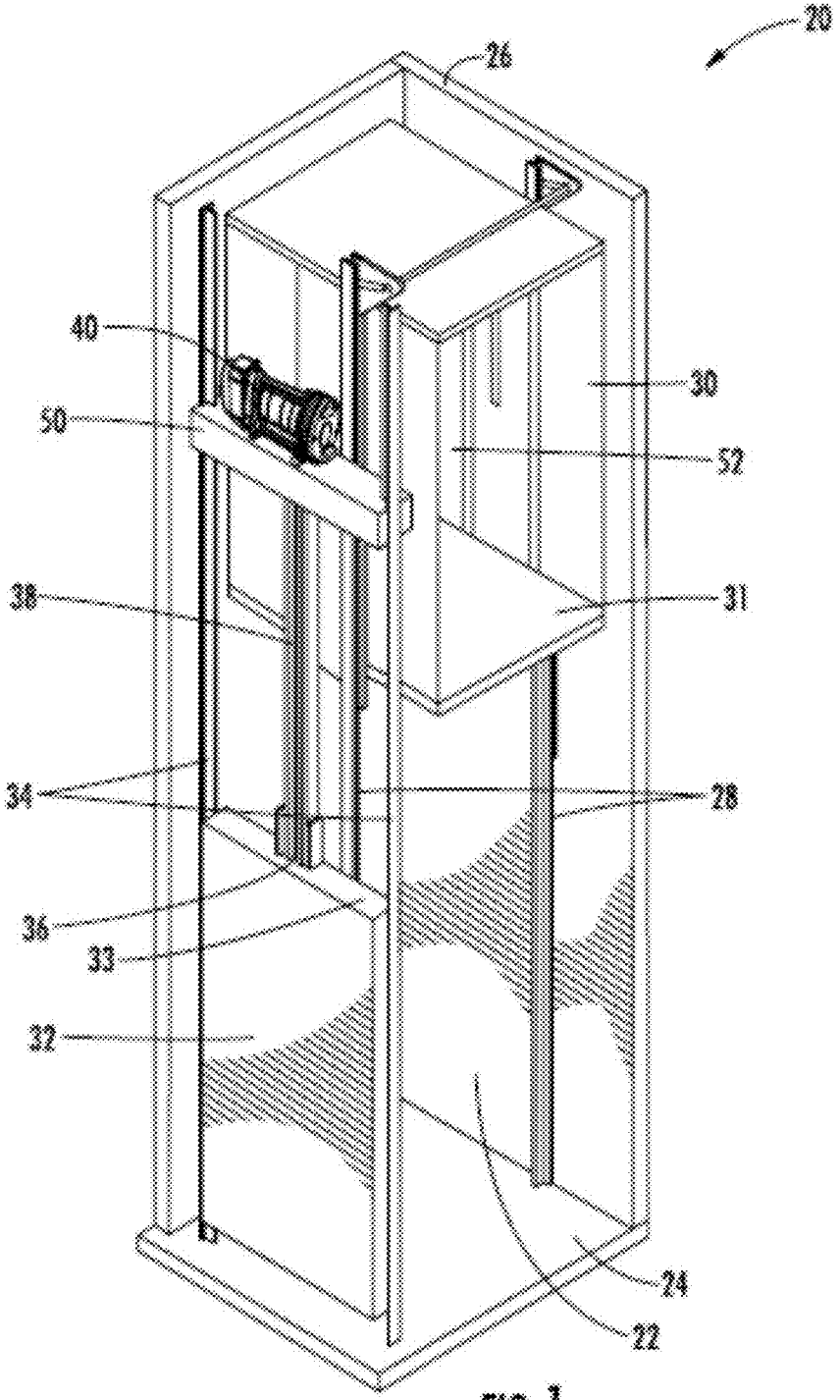
FIG. 1 is a perspective view of an example of an elevator system.

The detailed description of the invention describes exemplary embodiments of the invention, together with some of the advantages and features thereof, by way of example with reference to the drawings.

DETAILED DESCRIPTION OF THE INVENTION

Referring now to the FIGS., an elevator system 20 according to an exemplary embodiment of the present invention is illustrated. The elevator system 20 is located within a hoistway 22 having a plurality of landings (not shown) and extends generally from a floor 24 to a ceiling 26 of the hoistway 22. The hoistway 22 may extend over the entire height of a building, or alternatively, over only a portion of the height of a building. The elevator system 20 may be used in any type of elevator application, including low-rise, mid-rise, and high-rise applications. The elevator system 20 includes car guide rails 28 located on opposing sides of an elevator car 30 which guide the movement of the elevator car 30 within the hoistway 22. Guide assemblies 35 (see FIG. 2) configured to maintain proper alignment of the elevator car 30 as it travels along the car guide rails 28 are disposed adjacent the top and bottom of the elevator car 30.

The elevator system 20 also includes a counterweight 32 configured to move vertically upwardly and downwardly within the hoistway 22. The counterweight 32 is configured to move in a direction opposite the movement of the elevator car 30 as is known in conventional elevator systems 20. Movement of the counterweight 32 is guided by counterweight guide rails 34 mounted within the hoistway 22.

Figure 2:
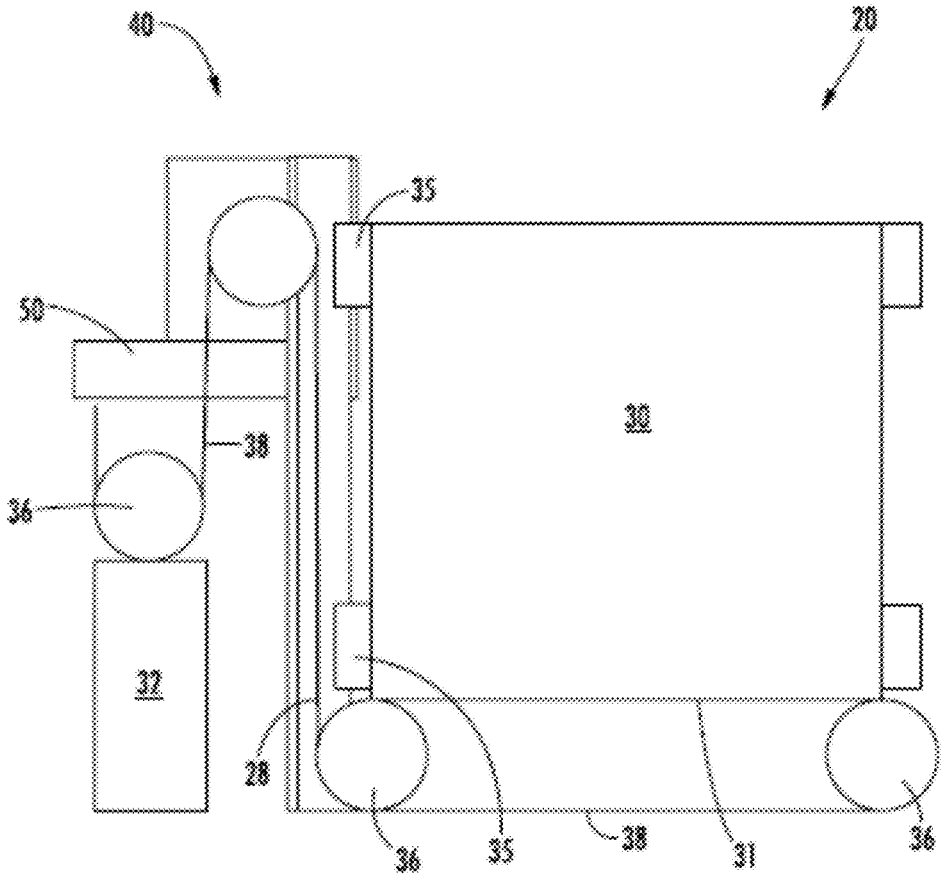
FIG. 2 is a side view of a portion of an elevator system according to an embodiment of the invention.

In the illustrated, non-limiting embodiment, the elevator car 30 and/or the counterweight 32 includes one or more deflector sheaves 36 configured to cooperate with at least one tension member 38 and a machine assembly 40 to raise and lower the elevator car 30 within the hoistway 22. The machine assembly 40 includes a traction sheave 46 (see FIG. 3) coupled to a machine shaft (not shown) for rotation about an axis X. The traction sheave 46 includes a plurality of grooves 48 configured for use with a plurality of tension members 38. In the illustrated, non-limiting embodiment, the traction sheave 46 is suited and sized for use with a plurality of flat, flexible belts; however systems 20 having other tension members 38, such as steel cables for example, are within the scope of the invention. The deflector sheaves 36 illustrated in FIGS. 1 and 2 are mounted to the bottom 31 of the elevator car 30 and to the top 33 of the counterweight 32. However, the deflector sheaves 36 may be mounted at another location on the elevator car 30 and counterweight 32, as recognized by a person having ordinary skill in the art.

The machine assembly 40 of the illustrated elevator system 20 is mounted atop of a support member 50, such as a bedplate for example, within the hoistway 22. As is known, opposed ends of the tension members 38 are terminated in the elevator system 20 at dead end hitches (not shown), such as integrally formed with the support member 50 for example. Although the elevator system 20 illustrated and described herein has an underslung 2:1 roping configuration, elevator systems 20 having other roping configurations and hoistway layouts are within the scope of the invention.

The support member 50 is positioned such that the machine assembly 40 is located generally within the hoistway 22, such as above a top landing but below the roof of the car 30 when parked at the top landing for example. However, embodiments where the machine assembly 40 is disposed between the top landing and a bottom landing of the hoistway 22 are also within the scope of the present disclosure. In addition, as shown in FIG. 2, the machine assembly 40 is arranged in an overlapping configuration with at least one of the car guide rails 28 to further reduce a width of the hoistway 22. As a result of this orientation, the machine assembly 40 is accessible from an interior 52 of the elevator car 30 when the elevator car 30 is positioned at one of the landings in the hoistway 22.

Figure 3:
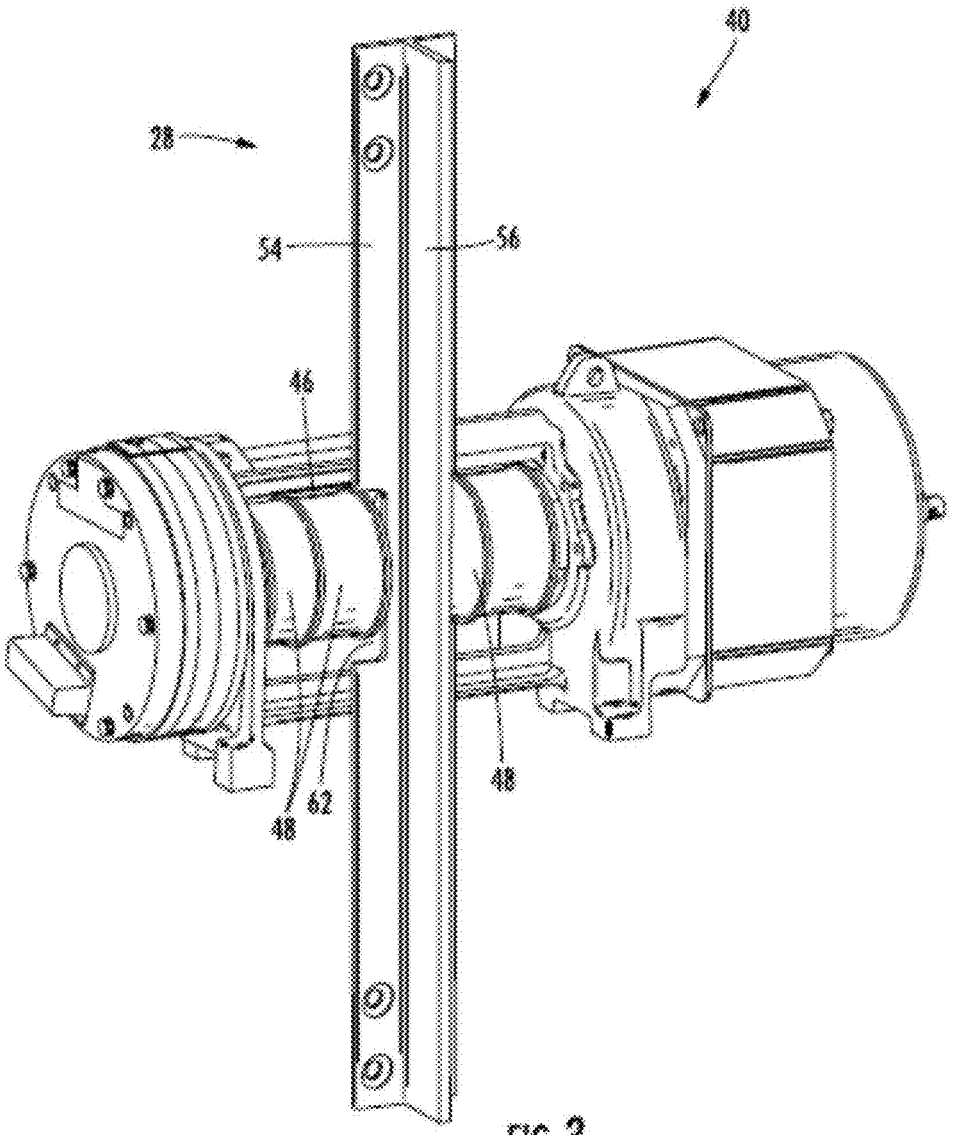
FIG. 3 is a perspective view of a machine assembly and a guide rail arranged in an overlapping configuration according to an embodiment of the invention.
Figure 4:
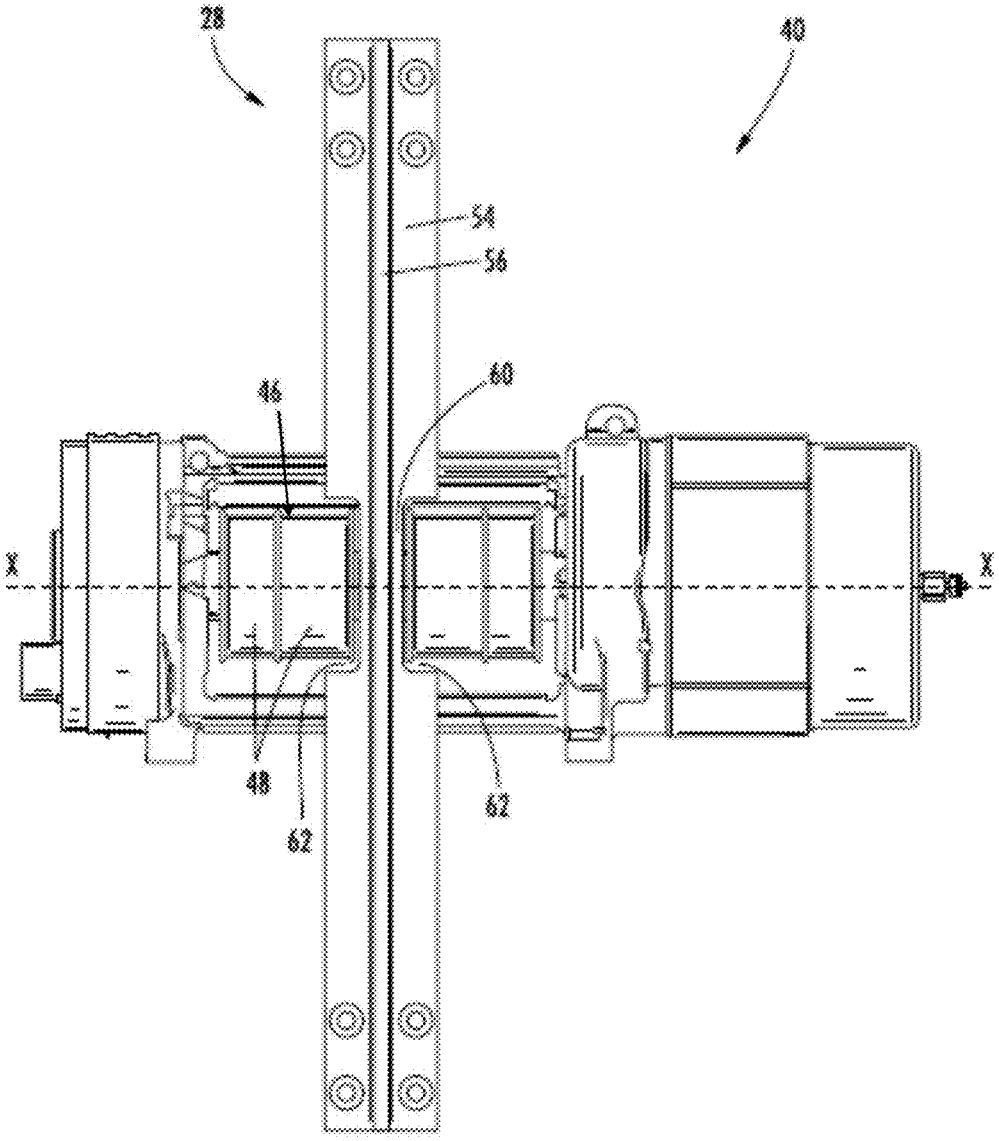
FIG. 4 is a front view of the machine assembly and guide rail arranged in an overlapping configuration of FIG. 3 according to an embodiment of the invention.
Figure 5:
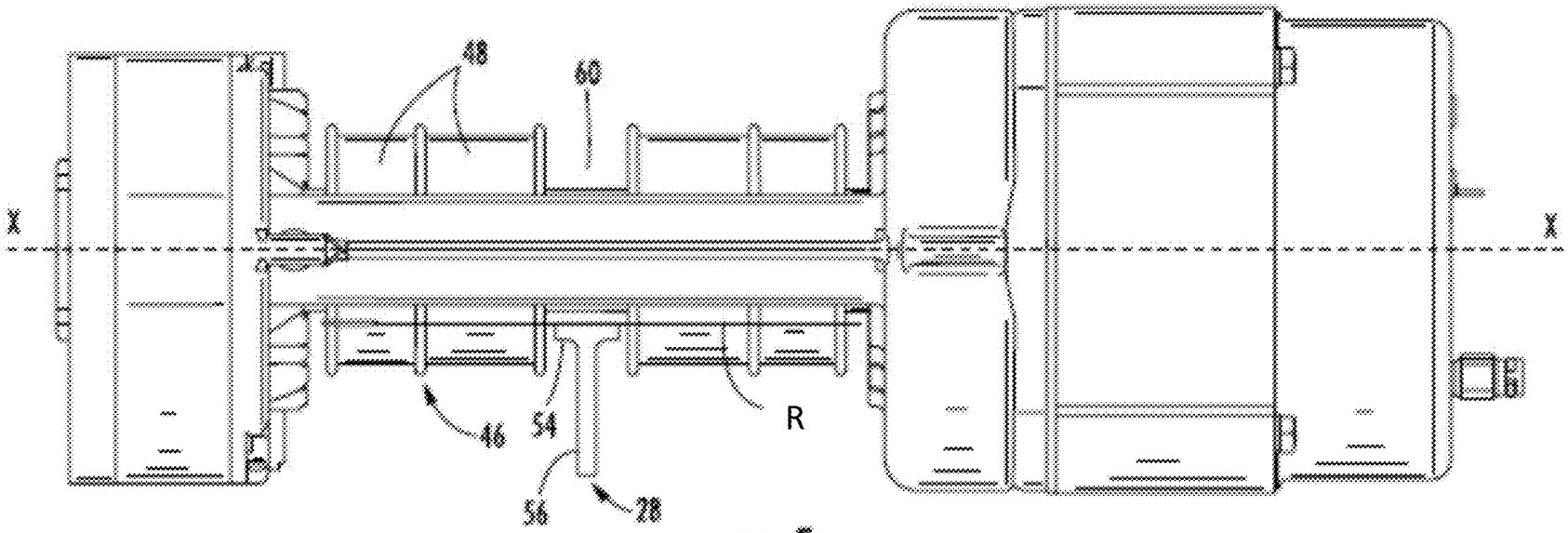
FIG. 5 is a top view of the machine assembly and guide rail arranged in an overlapping configuration of FIG. 3 according to an embodiment of the invention.

In the overlapping configuration, the plane R (best shown in FIG. 5) defined by the base 54 of the one or more car guide rails 28 extends generally parallel to the axis of rotation X of the machine assembly 40 and intersects a portion of the traction sheave 46. In one embodiment, as shown in the non-limiting embodiment illustrated in FIGS. 3-5, a car guide rail arranged in an overlapping configuration with the machine assembly 40 is positioned within the foot print of the machine assembly 40, and more particularly within the foot pint of the rotatable traction sheave 46. In other embodiments, having a plurality of car guide rails 28 arranged in an overlapping configuration with the machine assembly 40, one or more of the plurality of car guide rails 28 may be disposed outside the footprint of the machine assembly 40. For example, in an embodiment having two car guide rails 28 arranged in an overlapping configuration with the machine assembly 40, one of the car guide rails 28 arranged in an overlapping configuration with the machine assembly 40 may be arranged within the footprint of the machine assembly 40, and another of the car guide rails may be arranged outside the footprint of the machine assembly 40. Alternatively, both of the car guide rails 28 may be disposed within the footprint of the machine assembly 40. As shown in FIGS. 3-5, the car guide rail 28 arranged within the footprint of the machine assembly 40 is generally aligned with a central portion of the traction sheave 46. However, in other embodiments, a car guide rail 28 may be arranged in overlapping configuration with any portion of the traction sheave 46.

To accommodate the overlapping configuration between the at least one guide rail 28 and the machine assembly 40 when the car guide rail 28 is arranged within the footprint of the machine assembly 40, an opening 60 may be formed in the traction sheave 46. The opening 60 formed in the traction sheave 46 is large enough to accommodate the width of the rail blade 56, as well as at least one guide assembly 35 movably coupled to the rail blade 56 to prevent interference therewith as the elevator car 30 moves vertically throughout the hoistway 22. In one embodiment, the opening 60 is formed by removing one or more of the grooves 48 formed in the traction sheave 46. In another embodiment, the opening 60 is formed by significantly reducing the diameter of the portion of the traction sheave 46 arranged in an overlapping configuration with the car guide rail 28. Alternatively, a plurality of distinct traction sheaves 46 may be coupled to the machine shaft. Adjacent ends of the traction sheaves 46 may be separated from one another to define the opening 60 within which the guide rail 28 is received.

Figure 6:
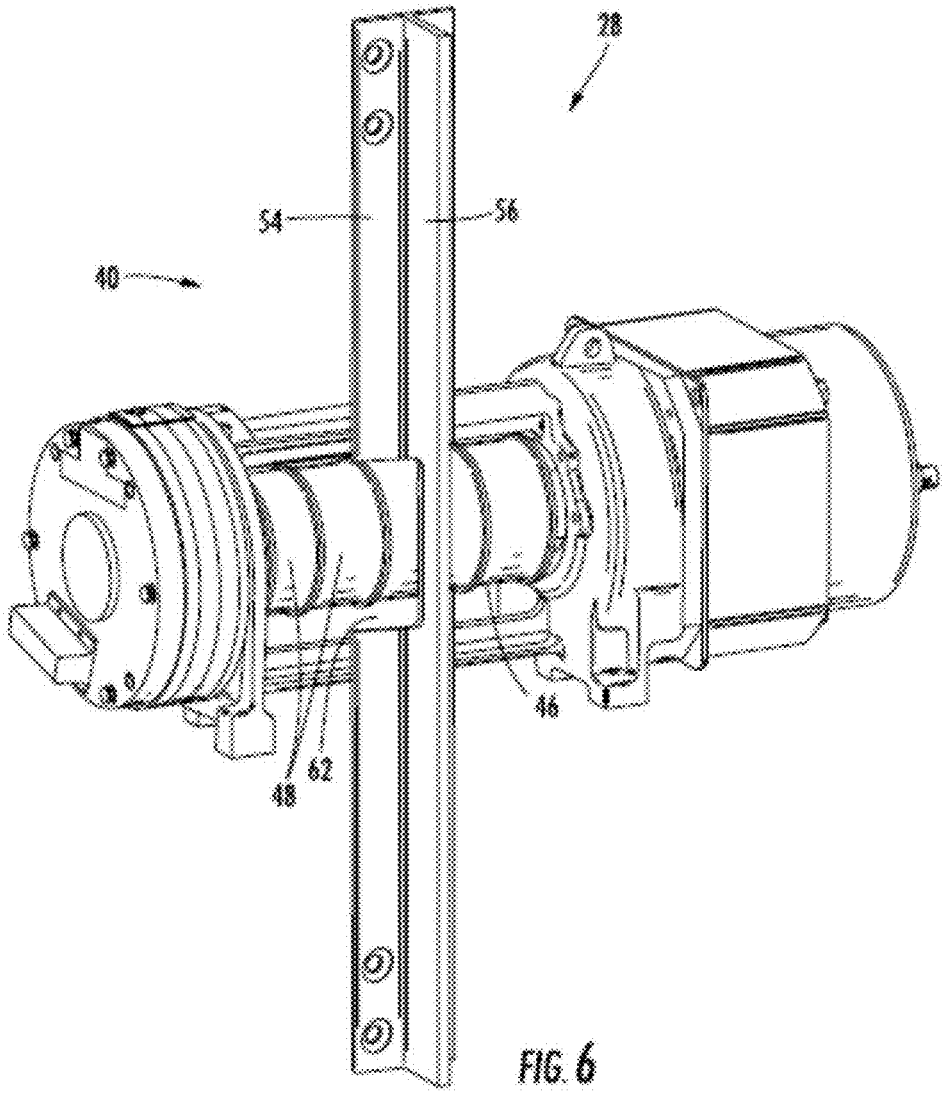
FIG. 6 is a perspective view of a machine assembly and a guide rail arranged in an overlapping configuration according to another embodiment of the invention.

In embodiments where the traction sheave 46 has a substantially constant diameter extending over its length, an overlapping configuration between the at least one car guide rail 28 and the machine assembly 40 when the car guide rail 28 is arranged within the footprint of the machine assembly 40 may be achieved by forming a cutout 62 in a portion of the car guide rail 28 (see FIG. 6). As shown, the car guide rails 28 extend vertically above and below the machine assembly 40. Depending on the configuration of the traction sheave 46 and the position of the car guide rail 28 relative to the traction sheave 46, one or more cutouts or notches 62 may be formed in the guide rail base 54, and possibly a portion of the rail blade 56, to avoid interference with the adjacent surfaces of the rotatable traction sheave 46. As shown, a length of the one or more notches 62 is typically greater than a diameter of the traction sheave 46 to ensure that a clearance exists between an outer periphery of the traction sheave 46 and the car guide rail 28. The car guide rails 28 may be formed of one or more pieces of from solid steel, or alternatively, from bent sheet metal. Although a car guide rail 28 is illustrated and described in an overlapping configuration with the machine assembly 40, other embodiments where one or more counterweight guide rails 34 are arranged in an overlapping configuration with the machine assembly 40, such as within the foot print thereof for example, are also within the scope of the disclosure.

By positioning the machine assembly 40 in an overlapping configuration with at least one of the car guide rails 28, the overall width of the elevator system is reduced without negatively impacting the guidance of the elevator car 30 through the hoistway 22. The elevator system 20 will also comply with proposed changes to one or more elevator codes. In addition, because the machine assembly 40 as disclosed herein is directly accessible from an interior of the elevator car 30, the safety and ease of performing inspection and maintenance operations is also significantly increased.

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator system, comprising:

a hoistway having a plurality of landings;

an elevator car configured to move within the hoistway between the plurality of landings;

a plurality of guide rails configured to guide movement of at least one of the elevator car and a counterweight arranged within the hoistway, wherein each of the plurality of guide rails includes a base and a blade; and a machine assembly mounted within the hoistway and including a traction sheave rotatable about an axis, the traction sheave being configured to drive movement of the elevator car between the plurality of landings, wherein at least one of the plurality of guide rails is arranged in an overlapping configuration with the machine assembly such that a plane defined by the base of the at least one guide rail is parallel to the axis and intersects a portion of the traction sheave, and at least one notch is formed in the base of the at least one guide rail such that a clearance exists between an outer periphery of the traction sheave and the base of the at least one guide rail.

2. The elevator system according to claim 1, wherein the at least one guide rail is positioned within an opening formed in the traction sheave.

3. The elevator system according to claim 2, wherein the opening is greater than the at least one guide rail.

4. The elevator system according to claim 1, wherein multiple guide rails are arranged in an overlapping configuration with the machine assembly, and each of the guide rails is arranged within a footprint of the machine assembly.

5. The elevator system according to claim 1, wherein multiple guide rails are arranged in an overlapping configuration with the machine assembly, at least one of the guide rails being arranged outside of a footprint of the machine assembly.

6. The elevator system according to claim 1, wherein the at least one guide rail extends vertically above the machine assembly.

7. The elevator system according to claim 1, wherein the machine assembly is positioned adjacent a top landing of the plurality of landings.

8. The elevator system according to claim 1, wherein when the elevator car is parked at an adjacent landing, the machine assembly is accessible from an interior of the elevator car.

9. The elevator system according to claim 1, wherein the at least one guide rail arranged in an overlapping configuration with the machine assembly is formed from solid steel.

10. The elevator system according to claim 1, wherein the at least one guide rail arranged in an overlapping configuration with the machine assembly is formed from bent sheet metal.

* * * * *